US006179747B1

(12) United States Patent
Kelley

(10) Patent No.: US 6,179,747 B1
(45) Date of Patent: Jan. 30, 2001

(54) ONE PIECE FACE AND NECK EXERCISER

(76) Inventor: Lillie P. Kelley, 930 Marshall Unit D, St. Louis, MO (US) 63119

( * ) Notice: Under 35 U.S.C. 154(b), the term of this patent shall be extended for 0 days.

(21) Appl. No.: 09/235,923

(22) Filed: Jan. 22, 1999

(51) Int. Cl.[7] ..... A63B 23/025
(52) U.S. Cl. ..... 482/11; 482/10; 482/120
(58) Field of Search ..... 482/10, 11, 122, 482/121, 124, 131; 602/74, 32–35; 2/9, 425; 128/845, 848, DIG. 19

(56) References Cited

U.S. PATENT DOCUMENTS

| | | | | |
|---|---|---|---|---|
| 523,192 | | 7/1894 | Angle . | |
| 862,881 | | 8/1907 | Case . | |
| 1,587,558 | | 6/1926 | Sheffield . | |
| 1,953,088 | | 4/1934 | Purdy | 272/57 |
| 1,992,904 | | 2/1935 | Preston | 128/89 |
| 2,453,934 | | 11/1948 | Preston | 128/87 |
| 2,507,617 | | 5/1950 | Swendiman | 128/87 |
| 3,497,217 | | 2/1970 | Feather | 272/83 |
| 3,571,930 | | 3/1971 | DaWaskin | 32/14 |
| 3,721,439 | | 3/1973 | Hans | 272/83 |
| 3,736,925 | | 6/1973 | Erman | 128/76 |
| 3,759,256 | | 9/1973 | O'Malley | 128/89 |
| 3,813,096 | | 5/1974 | Welch | 272/82 |
| 4,195,833 | | 4/1980 | Svendsen | 272/95 |
| 4,650,182 | | 3/1987 | Ross | 272/95 |
| 4,666,148 | | 5/1987 | Crawford | 272/95 |
| 4,744,556 | | 5/1988 | Shaffer | 272/94 |
| 4,909,502 | | 3/1990 | Beeuwkes | 272/95 |
| 5,003,968 | * | 4/1991 | Mars | 128/87 |
| 5,035,420 | | 7/1991 | Beeuwkes | 272/95 |
| 5,336,139 | | 8/1994 | Miller | 482/10 |
| 5,431,610 | | 7/1995 | Miller | 482/11 |
| 5,484,359 | | 1/1996 | Wabafiyebazu | 482/11 |
| 5,501,646 | | 3/1996 | Miller | 482/11 |
| 5,507,707 | * | 4/1996 | Miller | 482/10 |
| 5,509,869 | * | 4/1996 | Miller | 482/10 |
| 5,556,357 | | 9/1996 | Hanna | 482/11 |
| 5,577,983 | | 11/1996 | Fraser | 482/11 |

OTHER PUBLICATIONS reg. #18273356 Jan.–1993 Facial Flex™ 044.

* cited by examiner

*Primary Examiner*—Glenn E. Richman

(57) ABSTRACT

A one piece face and neck exerciser (10), specifically configured to tone the muscles of the forehead, face, chin and neck, comprising a head band (12) to which two elongated beginners head resistance bands (88) are attached into head grooves (20) extending outwardly and down to be permanently attached to the lateral parts of the chin cup (38). Also comprising a neck band (57) to which two elongated beginners neck resistance bands (104) are attached into neck grooves (64) extending outwardly and up to be permanently attached to the lateral sides of the chin cup (42). The frontal head band (14), and lateral head band (16), the frontal neck band (58) and lateral neck band (60) are made of a strong, durable, lightweight material, the posterior head band (32), and posterior neck band (76) are made of velcro fasteners (34), (36), (78), and (80). The one piece exerciser (10) is secured to the users face by first placing the head band (12) on the forehead and connecting the posterior velcro ends (34) and (36) on top of each other, secondly placing the chin cup (38) on and under the chin, and lastly, placing the neck band (57) around the neck and connecting the posterior velcro ends (78) and (80) on top of each other. Increased resistance is provided by the use of additional resistance bands (86) and (102).

4 Claims, 8 Drawing Sheets

ONE PIECE FACE AND NECK EXERCISER

BACKGROUND—FIELD OF INVENTION

The present invention relates to a one piece exercise configuration for toning the muscles of the face and neck regions.

BACKGROUND—DESCRIPTION OF PRIOR ART

In recent years, there have been a number of innovations in exercising equipment to enable people to utilize various body muscles in a capacity in which they would otherwise not be exercised. However, very little has been done in this area in order to permit people to exercise facial and neck muscles.

It has been recognized for many years that the facial and neck muscles like those of the rest of the human body, can improve in tonicity by exercise practiced over a long period of time and on a consistent basis. It has also been recognized that exercising jaw muscles and other facial muscles will have a tendency to decrease fat beneath the skin of the human being. Consequently, facial muscles exercising has a tendency to actually improve the appearance of an individual's face and neck by decreasing fat in these areas. Even more so, it has been found that the muscles which are strained by movement of the jaw when properly exercised, will decrease wrinkles around the eyes, due to the fact that it will cause a conditioning of the skin in the area around the eyes.

Various devices have been devised to strengthen or improve face and neck muscles through exercise. Generally, these comprise means of compression. The following U.S. patents show various devices for exercising specific facial, neck and chin muscles: U.S. Pat. Nos. 2,507,617; 3,571,930; 4,195,833; 4,650,182; 4,666,148; and 5,366,139.

U.S. Pat. No. 4,650,182, to Ross, is designed particularly for the exercise of the jaw, specifically designed to exercise the muscles of mastication and their auxiliaries. A headband is connected to a chin strap by flexible strips. One moves or opens his/her jaw against the elastic resistance force of the elastic resistance coupling members, thus strengthening the muscles of mastication and auxiliaries. The primary purpose of this device is to supplement therapeutic modality for relief of temporamandibular joint and/or myo-facial pain symptoms. The disadvantages of this device are: (1) Its use is intended for the medical profession and not the general public. (2) It does not tone the forehead because the upper head band is a flexible strip which does not provide resistance against the movement of the forehead muscles. (3) When closing the mouth the muscles of mastication are not being toned because this device does not provide any resistance coming from beneath the mandible. (4) The device is not made to tone the muscles of the neck. (5) Its parts are not contiguous, therefore, the user must connect the parts together each time the device is used.

The inventor has personally used for more than a year a device sold under the trademark Facial-Flex exerciser. This device is purported to provide the effects of a face lift without surgery. With this device, two U-shaped portions are wedged in the corners of the mouth, then the user forms an "O" by pressing and releasing the mouth. The mouth is moved such that the interconnecting rods expand and contract linearly. Disadvantages of the Facial-Flex exerciser are: (1) It is difficult to keep the accumulation of saliva from coming out of the mouth when using the device. (2) The Facial-Flex exerciser is designed to target the chin, cheeks, and neck muscles, it does not target the masseter and the temporal muscles. These two muscles are very important when toning facial muscles because they are the only muscles in the face which greatly influence surface form. (3) This device tones the targeted muscles only when the mouth is pressed together, there is no toning when the mouth is released, therefore, the antagonistic muscles to the chin, cheeks and neck are not being toned. (4) This device does not tone the forehead. (5) This device utilizes metal rods which may present a safety problem while driving or engaging in athletic activity and an accident occurs. (6) The use of this device does not provide any support for retaining the shape of the lips, and therefore, deep wrinkles extending perpendicularly from the lips, which are often called "whistle-marks" may form with extended use of this device.

The inventor has also used the Chin Gym exerciser U.S. Pat. No. 4,744,556, to Shaffer, this is an isometric chin, neck and jaw exerciser it targets the masseter, mylohyoid, and platysma muscles. The Chin Gym exerciser is a C-shaped structure having two free ends. One free end is adapted to fit within the mouth of the user, and the second free end fits under the chin. Weights are added to the structure to cause the second free end to press upward against the lower jaw and chin muscles, while at the same time exerting a resistance against the upper jaw muscles. The Chin Gym exerciser workout is a gradual progression. The user begins slowly and gradual increase the workout time. Once the user is able to hold the Chin Gym exerciser in the mouth, without removing it for 15 minutes, additional weights can be added. The workouts should have little to no movement. Disadvantages of the Chin Gym exerciser are: (1) Saliva accumulation in the mouth. (2) It depends on an isometric response, which is a force against an unmovable source. Therefore, other than reading a book or watching TV while in a setting position the Chin Gym exerciser does not allow a person to engage in other activities. (3) It does not tone the forehead. (4) It may damage bridge-work or dentures, and teeth that have been weakened by periodontal disease.

Objects and Advantages

Accordingly, several objects and advantages of the present invention are:

(1) to provide an exercise device that does not go into the mouth, thereby eliminating stress on the teeth and saliva accumulation;

(2) to provide an exercise device which can be used by people with periodontal disease,bridge-work, and dentures;

(3) to provide an exercise device which can be used when doing other activities such as driving, walking, house cleaning, etc.;

(4) to provide an exercise device that targets and tones the forehead;

(5) to provide a one piece exercise device that tones the masseter, temporal, and other major facial muscle groups simultaneously.

The present invention is more effective, efficient, and comprehensive because it is designed to exercise and tone more muscle groups.

Other Objects and Advantages are (6) to provide a facial and neck device which will create concentric upward and eccentric downward resistive force against the lower jaw, against which the jaw can be exercised in a number of directions;

(7) to provide a facial and neck device in which there is concentric and eccentric variable resistive force applied against the opening and closing of the jaw;

(8) to provide an exercise device which is safe to use when conditioning and toning the muscles of the face and neck;

(9) to provide a exercise device having an easily manipulatable adjusting mechanism for adjusting the tension in the device;

(10) to provide ease in placing and removing the exercise device;

(11) to provide a facial exerciser that can be kept in sanitary condition;

(12) to provide an adjustable head band, chin cup, and neck band which is adjustable in all dimensions;

(13) to provide adjustable head band, neck band, and chin cup with a minimum of fitting time;

(14) to provide a device which will be capable of adjustment to fit any shaped face, chin, and neck, which is capable of simple and convenient adjustment to permit its use without assistance;

(15) to provide a head band, chin cup, and neck band which can be shaped or molded to the specific contour to which it is to be applied so that its use will not prove inconvenient or uncomfortable;

(16) to provide an adjustable light weight head band, and neck band for mounting: resistance bands, velcro backing, fastening means, grooves, notches, and other attachment for exercising, the face and neck muscles;

(17) to provide an exercise device of this nature which is easy to assemble, one which possesses an exceedingly simple construction so that it may be manufactured at a relatively low cost;

(18) to provide an exercise device of this nature which is light weight, strong, durable, efficient in use, and otherwise well adapted to the purpose for which it is designed;

These and other objects of the present invention are accomplished by means of the present device which includes: a head band which goes around the head, a neck band which fits around the neck, a chin cup which fits around and under the chin, and a plurality of beginners resistance bands for the head and neck. The parts are contiguous in that the resistance bands for the head are permanently connected to the head band and the chin cup, and the resistance bands for the neck are permanently connected to the neck band and the chin cup.

Due to its design, and the materials used, the present invention is able to target more facial muscle regions, than most other devices, that are available to the general public today. Its part are permanently connected, therefore, the user does not have to put it to together each time it is used. Additionally, the present invention does not go into the mouth, therefore, damage to the teeth and saliva accumulation are not a problem.

These and other objects and many of the attendant advantages of this invention will be readily appreciated as the same becomes better understood by reference to the following detailed description when considered in connection with the accompanying drawings.

DRAWING FIGURES

In the drawings, closely related figures have the same number but different alphabetic suffixes.

REFERENCE NUMERALS IN DRAWINGS

Figure 1A:
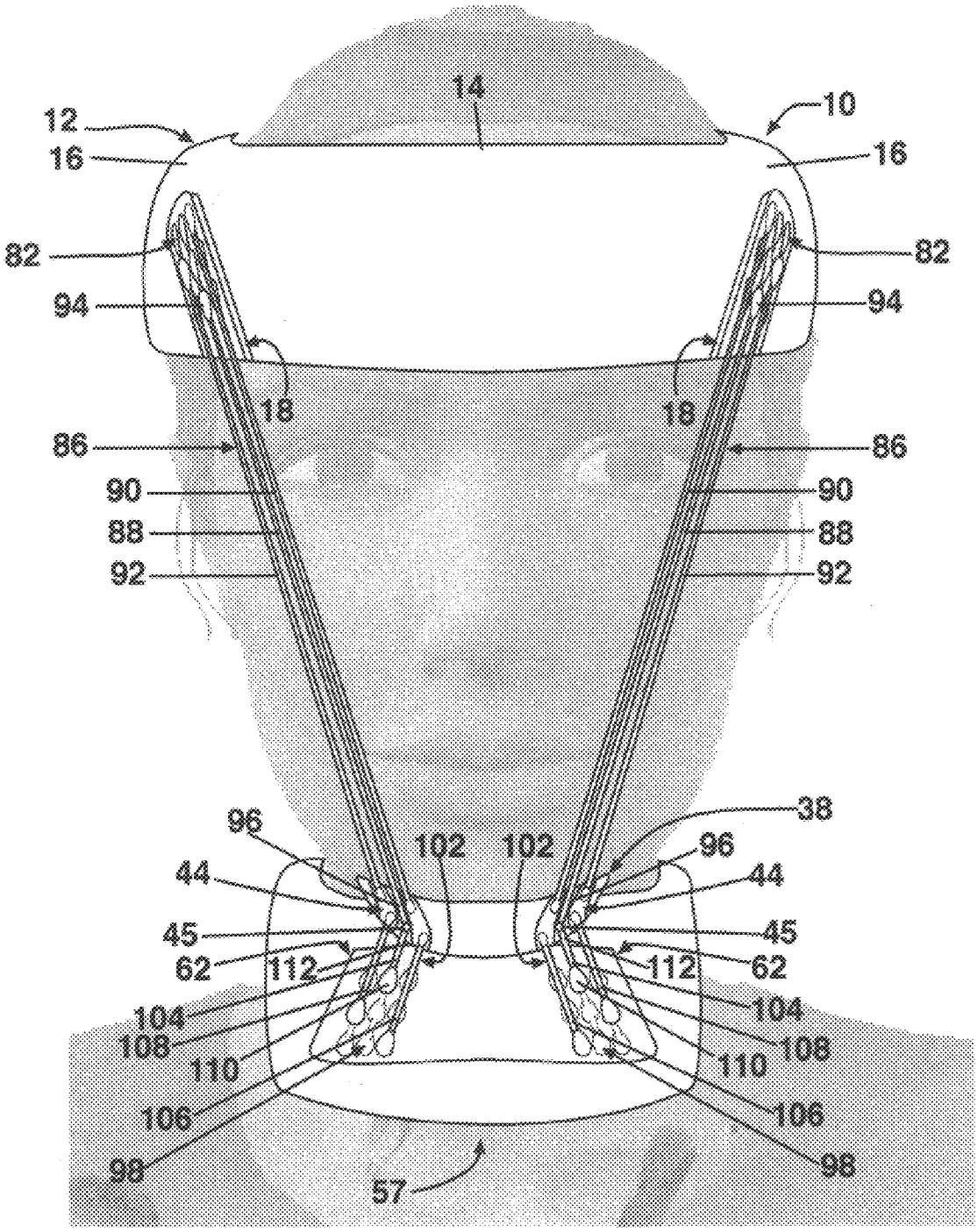
FIG. 1A is a frontal view of one embodiment of the one piece face and neck exercise device of the present invention.
Figure 1B:
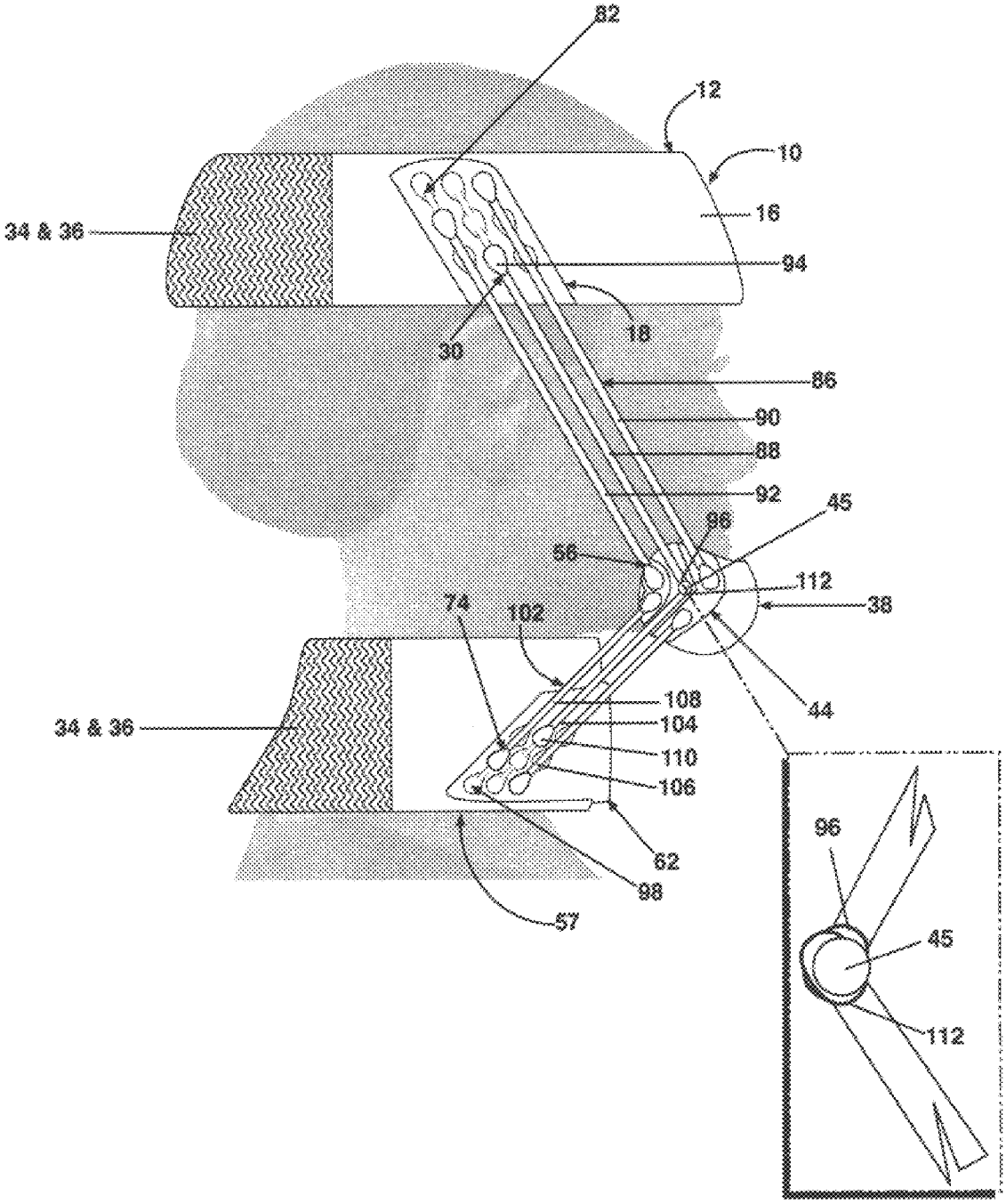
FIG. 1B is a lateral view of one embodiment of the one piece face and neck exercise device of the present invention.

10 ONE PIECE FACE AND NECK EXERCISER
- 12 Head Band
  - 14 frontal part
  - 16 right and left lateral part
- 18 right and left head fastening means
  - 20 head grooves
  - 22 beginners head groove
  - 24 intermediate head groove
  - 26 advanced head groove
  - 28 head notches
  - 30 head gripping points
  - 32 posterior part
  - 34 head velcro fastener Reference Numerals In Drawings Cont.

- 36 head velcro fastener
- 38 Chin Cup
  - 40 frontal part
  - 42 right and left lateral part
- 44 right and left chin attachment means
  - 45 right and left chin attachment knob
  - 46 chin grooves
  - 48 intermediate head notches
  - 50 intermediate neck notches
  - 52 advanced head notches
  - 54 advanced neck notches
  - 56 chin gripping points
- 57 Neck Band
  - 58 frontal part
  - 60 right and left lateral part
- 62 right and left neck fastening means
  - 64 neck grooves
  - 66 beginners neck groove
  - 68 intermediate neck groove
  - 70 advanced neck grooves
  - 72 neck notches
  - 74 neck gripping points
  - 76 posterior part
  - 78 neck velcro fastener
  - 80 neck velcro fastener
- 82 Head Resistance Means
  - 86 head resistance bands
  - 88 beginners head resistance bands
  - 90 intermediate head resistance bands
  - 92 advanced head resistance bands Reference Numerals In Drawings Cont.

- 94 head fastening ends
- 96 head attachment ends
- 98 Neck Resistance Means
  - 102 neck resistance bands
  - 104 beginners neck resistance bands

106 intermediate neck resistance bands
108 advance neck resistance bands
110 neck fastening ends
112 neck attachment ends Summary The present invention generally concerns an apparatus for exercising the muscles of the face and neck of a person. The invention more particularly comprises a head band to be secured around the head, a neck band to be secured around the neck and a chin cup adapted to fit around a person's chin. An adjustable resistance band extending diagonally down from the right and left lateral portion of the headband permanently connects to the right and left lateral portion of the chin cup. An adjustable resistance band extending diagonally up from the right and left lateral portion of the neck band permanently connects to the right and left lateral portion of the chin cup. Four head and four neck resistance bands are also provided to give additional resistance as the user progresses.

In use, the headband is placed on the mid-section of the user's forehead above the ears by means of the velcro fasteners. The chin cup is positioned on the user's chin, and the neck band is wrapped around the user's neck by means of the velcro fasteners. Once in position, the user exercises the face and neck by moving the mouth in different directions and making various facial expressions, against the force of the elastic resistance bands. By repetitive exercise and use, the user may strengthen the major muscles of the face and neck.

Description—FIGS. 1A to 5

FIGS. 1A (frontal) and 1B (lateral) shows an overall view of a basic version of a piece exercise device for the face and neck 10. The main parts of the one piece exercise device for the face and neck 10 are: a head band 12, a chin cup 38, a neck band 57. The one piece exercise device for the face and neck 10, further includes: a plurality of beginners head resistance bands 88, and a plurality of beginners neck resistance bands 104. A plurality of head resistance means 82 is used to fasten a head fastening end(s) 94 of the beginners head resistance band(s) 88 to the center of a right and left head fastening means 18. Additionally, the head resistance means 82 is used to permanently attach a head attachment end 96(s) of the beginners head resistance band (s) 88 to the center of a right and left chin attachment means 44. A plurality of neck resistance means 98 is used to fasten a neck fastening end(s) 110 of the beginners neck resistance band(s) 104 to the center of a right and left neck fastening means 62. Additionally, the neck resistance means 98 is used to permanently attach a neck attachment end(s) 112 of the beginners neck resistance band(s) 104 to the center of the chin attachment means 44.

Figure 2A:
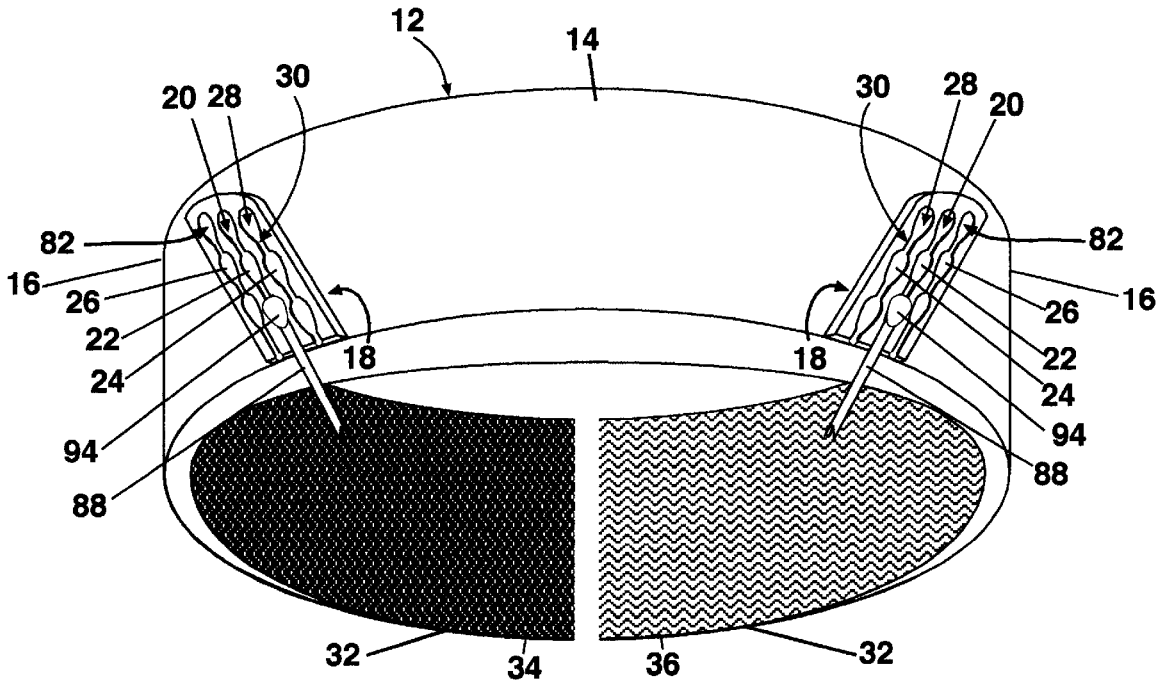
FIG. 2A is a detailed frontal view of the head band.
Figure 2B:
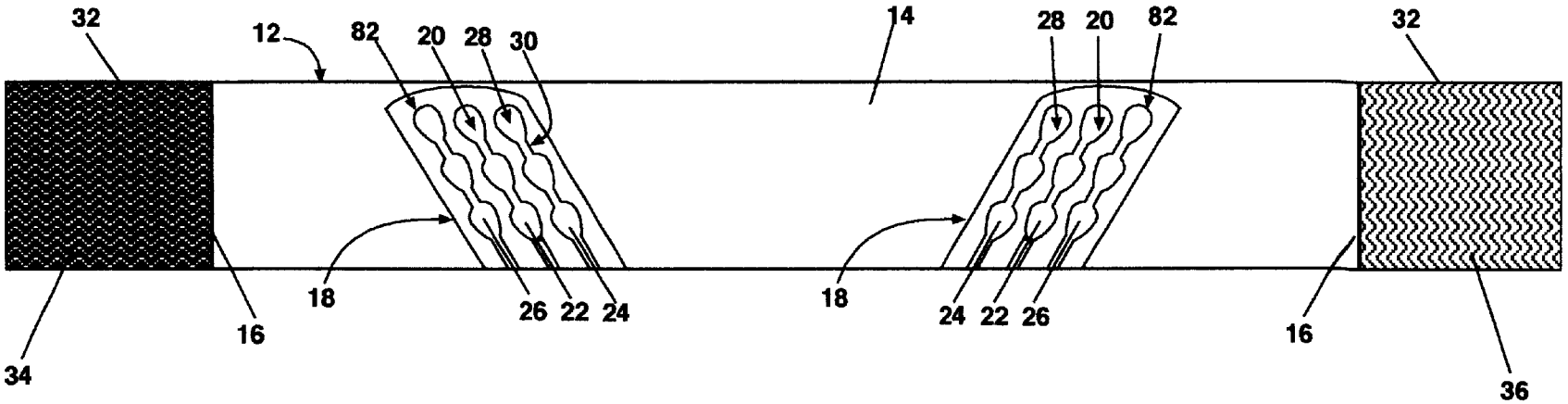
FIG. 2B is a detailed frontal spread of the head band.
Figure 2C:
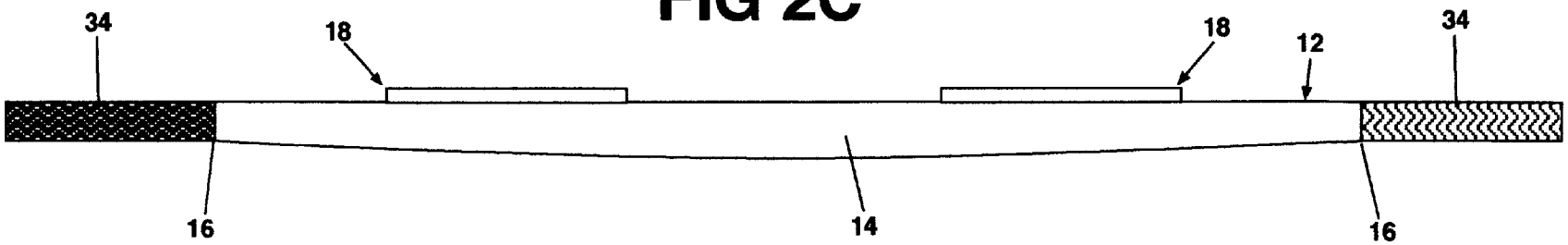
FIG. 2C is a detailed lateral spread of the head band.

FIG. 2A (frontal), FIG. 2B(frontal spread) and FIG. 2C(lateral spread) gives an overall view of the head band 12 of my one piece exercise device for the face and neck 10.

Protruding from a right and left lateral part(s) 16 of the head band 12 are the head fastening means 18. Made into each head fastening means 18 is a plurality of head grooves 20, a plurality of head notches 28, and a plurality of head gripping points 30.

The head fastening means 18 is comprised of three slanting head grooves 20: a beginners head groove 22, an intermediate head groove 24, and an advanced head groove 26. Within each head groove 20 there are three head notches 28, extending from each head notch 28 is a head gripping point(s) 30.

The head gripping point(s) 30 on the beginners head groove 22 is designed to permanently secure the beginners head resistance band(s) 88 in the head groove 22, and to also allow for adjusting.

A frontal part 14 of the head band 12, the right and left lateral parts 16 of the head band 12, and the head fastening means 18 is made of a rigid material.

A posterior part 32 of the head band 12 is made of a head velcro fastener 34 and a head velcro fastener 36. The head velcro fastener 34 and the head velcro fastener 36 is permanently fitted into the lateral right and left part 16 of the headband 12.

Figure 3A:
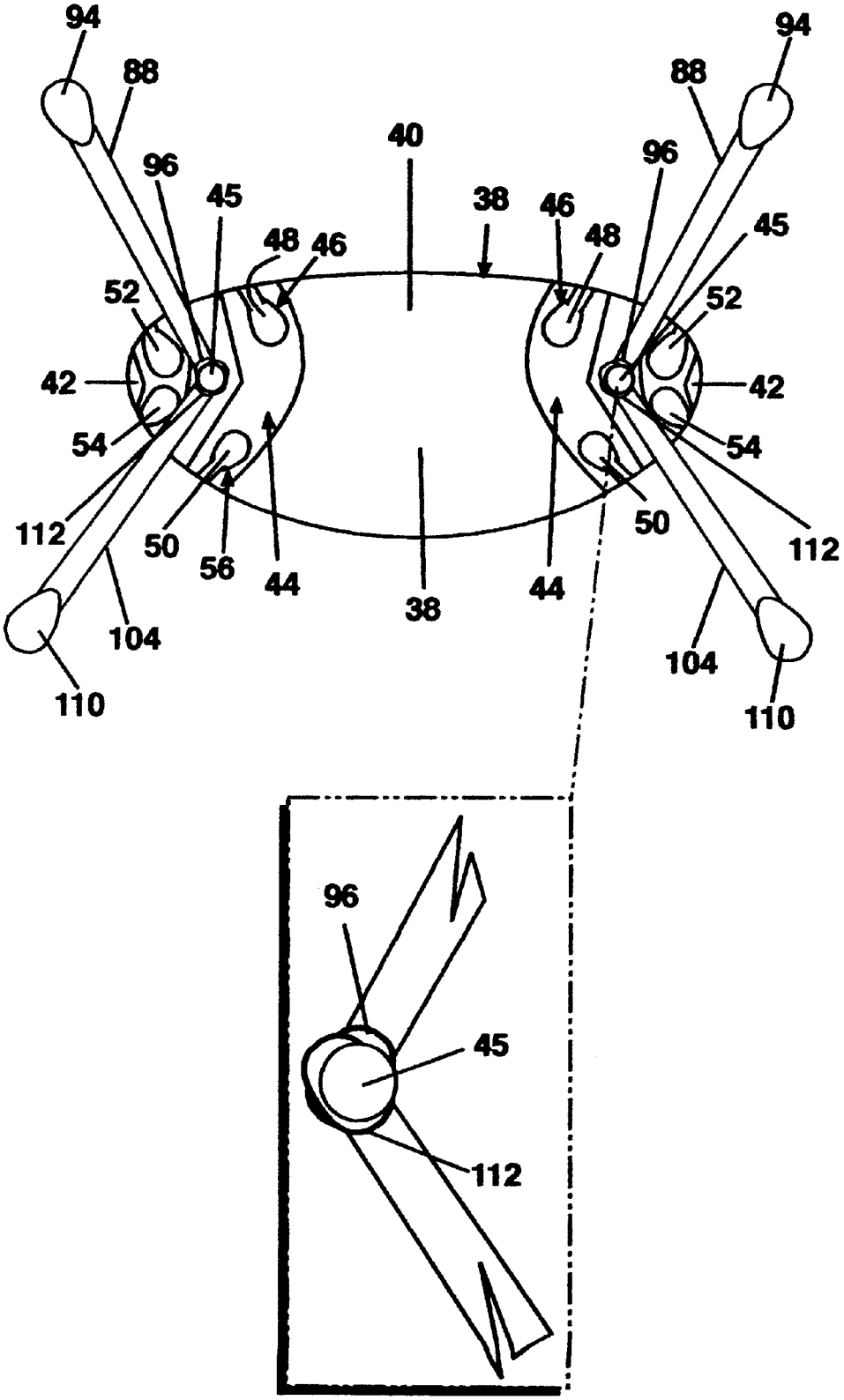
FIG. 3A is a detailed frontal view of the chin cup.

FIG. 3 shows an overall view of the chin cup 38 of my one piece exercise device for the face and neck 10.

Protruding from a right and left lateral part 42 of the chin cup 38 are two chin attachment means 44. Made into each chin attachment means 44, is a plurality of chin grooves 46. Within each chin groove 46 is an intermediate head notch 48, an intermediate neck notch 50, an advanced head notch 52, and an advanced neck notch 54. Extending from each notch 48, 50, 52, and 54, is a plurality of chin gripping point(s) 56.

Permanently connected to the center of the lateral parts 42 of the chin cup 38 is the head attachment ends 96 of the beginners head resistance bands 88. Also permanently connected to the center of the lateral parts 42 of the chin cup 38 is the neck attachment end 112 of the beginners neck resistance bands 104. The head attachment ends 96, and the neck attachment ends 112 are permanently secured to the chin cup 38 by a right and left chin attachment knob(s) 45.

The right and left chin grooves 46 on the chin cup 38 is in alignment with the right and left head grooves 20 on the head band 12, and the right and left neck grooves 64 on the neck band 57. The intermediate head notch 48 on the chin cup 38 is in alignment with the intermediate head groove 24 on the head band 12, the advanced head notch 52 on the chin cup 38 is aligned with the advanced head groove 26 on the head band 12. The intermediate neck notch 50 on the chin cup 38 is in alignment with an intermediate neck groove 68 on the neck band 57, the advanced neck notch 54 on the chin cup 38 is in alignment with an advanced neck groove 70 on the neck band 57.

A frontal part 40 of the chin cup 38, and the right and left lateral parts 42 of the chin cup 38 is made of a rigid material. The right and left lateral parts 42 of the chin cup 38 has the chin attachment means 44 protruding from each side, the chin attachment means 44 is made of a rigid material.

Figure 4A:
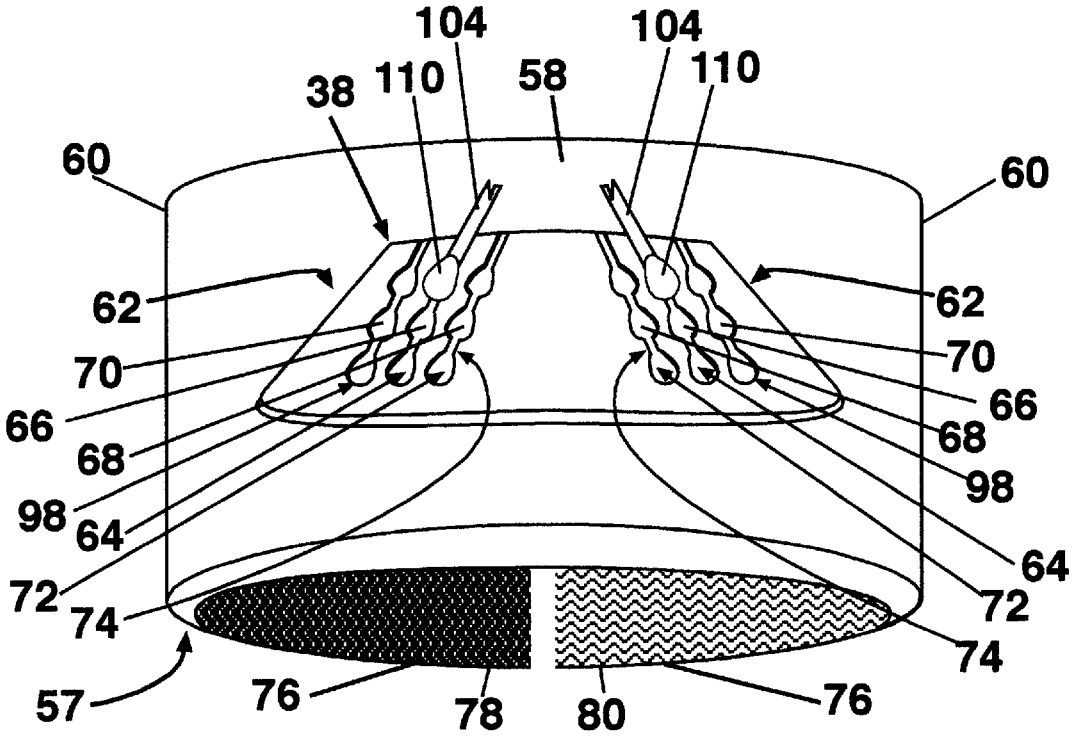
FIG. 4A is a detailed frontal view of the neck band.
Figure 4B:
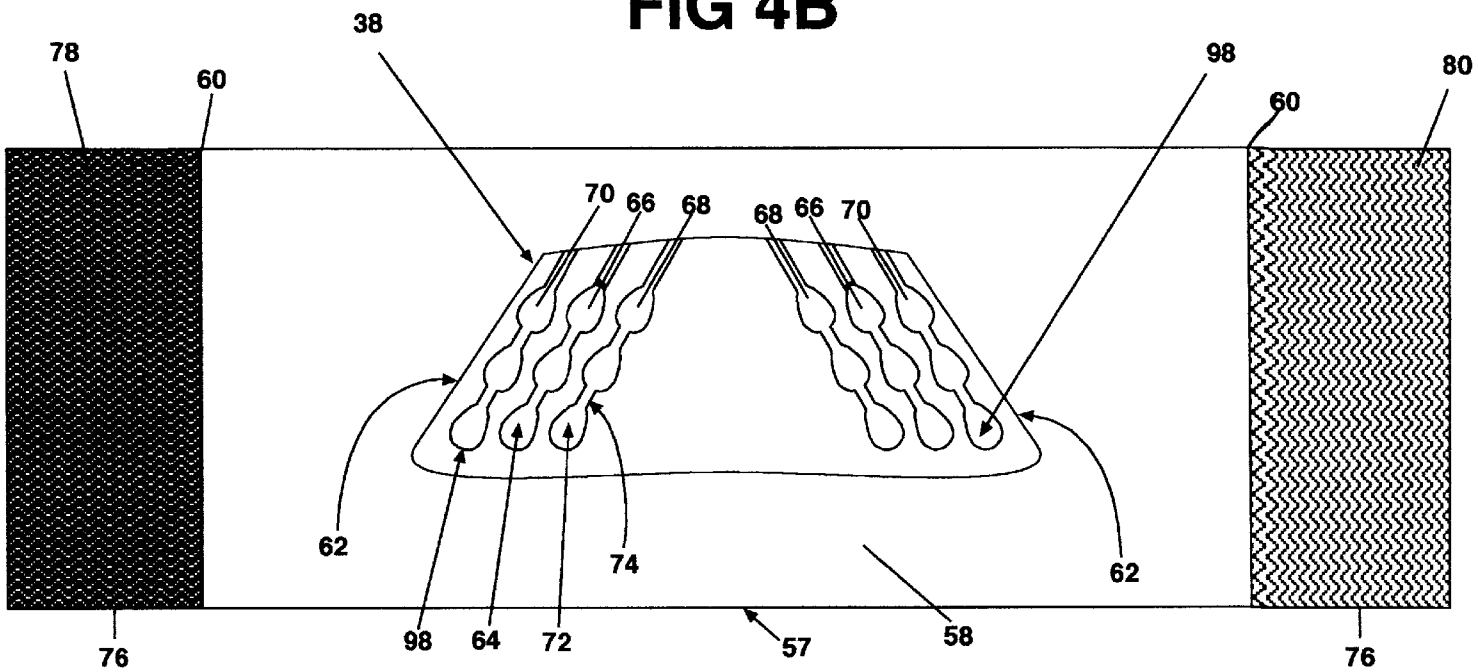
FIG. 4B is a detailed frontal spread of the neck band.
Figure 4C:
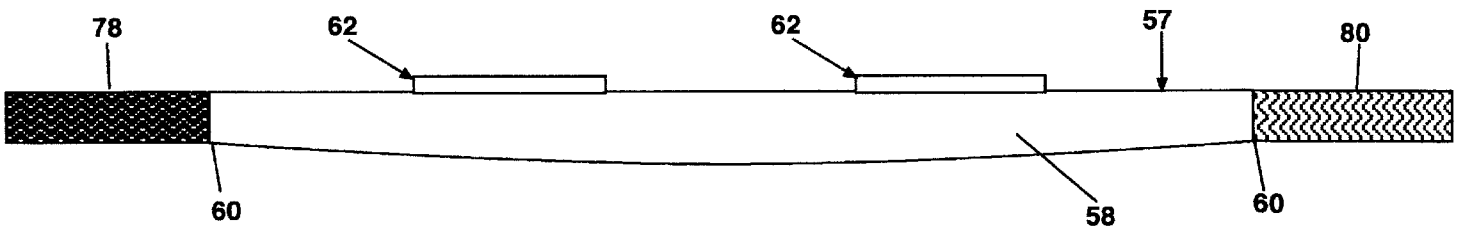
FIG. 4C is a detailed lateral spread of the neck band.

FIG. 4A(frontal), FIG. 4B(frontal spread) and FIG. 4C(lateral spread) gives an overall view of the neck band 57 of my one piece exercise device for the face and neck 10.

Protruding from a frontal part 58 of the neck band 57 are the neck fastening means 62. Made into each neck fastening means 62 is a plurality of neck grooves 64, a plurality of neck notches 72, and a plurality of neck gripping points 74.

The neck fastening means 62 is comprised of three slanting neck grooves 64: a beginners neck groove 66, the intermediate neck groove 68, and the advanced neck groove 70. Within each neck groove 64 there are three neck notches 72, extending from each neck notch 72 is a neck gripping point(s) 74.

The neck gripping point(s) 74 on the beginners neck groove 66 is designed to permanently secure the beginners neck resistance band 104 in the beginners neck groove 66, and to also allow for sizing.

The frontal part 58 of the neck band 57, the right and left lateral parts 62 of the neck band 57, and the neck fastening means 62 is made of a rigid material.

A posterior part 76 of the neck band 57 is made of a neck velcro fastener 78 and neck velcro fastener 80. The neck velcro fasteners 78 and 80 are permanently fitted into a lateral right and left part 60 of the neck band 57.

Figure 5:
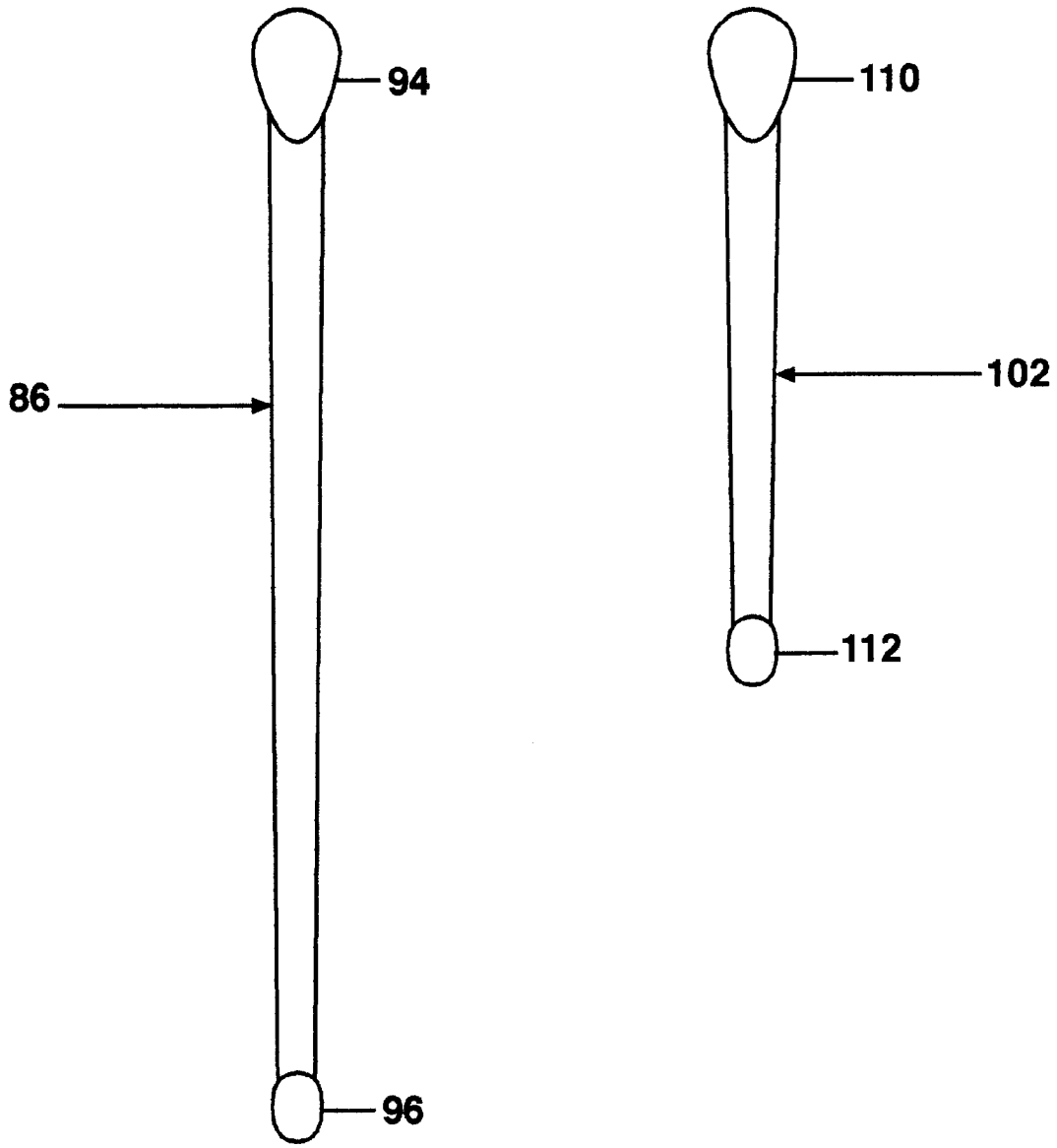
FIG. 5 is a view of the intermediate and advanced head and neck resistance bands.

FIG. 5 shows a frontal view of a head resistance band 86, and a neck resistance band 102.

The head resistance band(s) 86 is made of a resilient material with a knob attached to opposite ends, the head fastenings end(s) 94 and the head attachment end(s) 96. The neck resistance band(s) 102 is made of a resilient material with a knob attached to opposite ends, the neck fastening ends 110, and the neck attachment ends 112. The head resistance bands 86, and the neck resistance band 102 may comprise differing degrees of elasticity, however they will have sufficient tension to tone the muscles in the face and neck. In addition the length of the resistance bands may vary depending upon the elasticity of the resistance bands.

The head fastening end 94 on the head resistance band 86 is inserted into one of the head notches 28 on the intermediate head groove 24 of the head band 12, or the advanced head groove 26 of the head band 12. The head attachment end 96 of the head resistance band 86 is inserted into the intermediate head notch 48 on the chin cup 38, or the advanced head notch 52 on the chin cup 38.

The neck fastening end 110 on the neck resistance band 102 is inserted into one of the neck notches 72 on the intermediate neck groove 68 of the neck band 57, or the advanced neck groove 70 of the neck band 57. The neck attachment end 112 of the neck resistance band 102 is inserted into the intermediate neck notch 50 on the chin cup 38, or the advanced neck groove 54 on the chin cup 38.

The head fastening end(s) 94 and the head attachment end(s) 96 on the head resistance band 86, is made of a rigid material. The neck fastening end(s) 110, and the neck attachment end(s) 112 on the neck resistance band 102 is made of a rigid material.

An intermediate head resistance band(s) 90, and an advanced head resistance band(s) 92 are provided for further development of the facial and neck muscles. Also provided for further development is an intermediate neck resistance band(s) 106, and an advanced neck resistance band(s) 108.

Operation

In use, the head band 12 is attached to the upper portion of the user's head above the ears by means of the velcro fasteners 34 and 36 and or similar fastening means, the neck band 57 is attached to the neck by means of the velcro fasteners 78 and 80 and or similar fastening means, and the chin cup 38 is then positioned on the user's chin. The purpose of the head band 12 is to provide resistance from above, the purpose of the neck band 57 is to provide resistance from below. One of the main purposes of the chin cup 38, is to provide the means whereby the present invention 10 is configured into a one piece exercise device, when the head attachment ends 96 on the beginners head resistance bands 88, and the neck attachment ends 112 on the beginners neck resistance bands 104 are permanently attached to the chin cup 38. The chin attachment knob 45 holds the head attachment ends 96, and neck attachments ends 112 permanently in place, while allowing for adjustment and positioning of the device 10. Use of the head fastening means 18 protruding from the head band 12 eliminates the head resistance bands 86 from rubbing against the facial skin.

Once in position, the user uses the one piece face and neck exerciser 10 by moving the mouth, neck, and chin, in various directions against the resistance of the resistance bands 86 and 102. To tone the forehead the velcro fasteners 34 and 36 must be secured tightly behind the head and then the user simply raises the eyebrows up and down.

The muscles of the face are usually described as arising from the bones and inserted into the nose, lips, and corners of the mouth, they have fibres inserted into the skin of the face along their whole extent, so that almost every point of the skin of the face has its muscular fibre to move it.

When the device 10 is in operation, any movement caused by the user, such as blinking, closing the lips as if to kiss, compressing cheeks to whistle, opening the mouth, closing the mouth, protruding the lips to pout, laterally moving the lip to grimace, raising the edge of the mouth to smile, raising the upper lip to show disgust, moving the jaw from side to side, rotating the head, flexing the head and extending the head, is affected by the restraint effect of the resistance bands, thereby accomplishing an isotonic type of resistance for building facial, neck, and chin muscles. This device 10 also tones the muscle of the forehead by raising the eyebrows up and down against the resistance of the headband 12.

Once the muscles have begun to develop some tone the intermediate head resistance bands 90 and or advanced head resistance bands 92, the intermediate neck resistance bands 106 and or advanced neck resistance bands 108, can be attached to the head band 12 and neck band 57, thereby requiring more force on the part of the jaw, neck and chin muscles.

Resistance may be varied by increasing the number of resistance bands 86 and 102. The additional resistance is a very important preferred feature of the present invention 10. This is important because as soon as the user starts to perform the exercises and does them regularly, the muscles will quickly become stronger in the face, chin, and neck areas each time additional resistance is added.

The exercise device 10 of the present invention may be used in special exercise routines to exercise the muscles in the face and neck so that lines, crevasses and folds in the skin will be smoothed out or completely eliminated, enhanced cheek bones will be achieved, eyebrows will have a pronounced arch, eyes will appear larger and younger, the jaw line will be cleaner, the chin line will be more distinct and the corners of the mouth will no longer droop. Persons with facial structure beginning to slacken with age will slow down this process of wrinkling, jowls, pouches, and sagging neck skin with the one piece face and neck exercise device 10. The sagging caused by weight loss will be reduced as will double chins and jowls be toned up using this invention 10.

Use of this device 10 is not limited to any age group for even the muscular structure of the face and neck of persons still young will be enhanced and the facial firmness retained far longer into the advanced years.

The face and neck muscles are sensitive to movement, therefore, the benefits will be seen within a few weeks if performed regularly. Early and regular use of the exercise device 10 and a system of exercise will produce the best results for the longest time. The early morning and late evening when the face is cleaned is advised for circulation is improved by the exercises and the benefits of facial creams would also be enhanced.

The construction of the present invention over comes the following disadvantages of some prior art: possible damage to the teeth, saliva accumulation, inability to tone major facial muscles groups simultaneously, limited activity while the device is being used.

Conclusion, Ramifications, and Scope

I have shown the invention as having four main parts: a head band, a chin cup, a neck band, and a pair of resistance band for the head and. The head band is permanently connected to the chin cup with a right and left resistance band, and the neck band is permanently connected to the chin cup with a right and left resistance band. The frontal and lateral side of the head band is made of a hard material. Extending from the right and left lateral sides of the head band are protrusions for the permanent resistance band to connect to. Made into the protrusions are three slanting grooves which are used for additional resistance bands for intermediate users and advanced users, the grooves are also used to adjust the one piece device to fit the average head size. The posterior part of the head band is made of velcro, to allow for sizing, and fastening.

Due to its design and materials used, the present invention is not only different from prior art, it also overcomes the drawbacks of prior art. This is a one piece facial and neck exerciser that does not go into the mouth, it tones major facial muscles groups simultaneously, it can be used while doing other activities, and it tones the forehead.

It will be apparent that these parts may be of other materials, instead of using grooves for the resistance band to fit into, hooks could be used, instead of velcro as a fastening means we could use snaps, buckles etc. Rather than the resistance bands being made of a resilient material, a spring coil could be used. The head band and neck band could be made of plastic, rubber, metal, styrofoam, or fiberglass. Additionally, the head band, chin cup, and neck band could be padded with a soft material. The construction of the one piece exercise device is merely for the purpose of illustration, it being obvious that other arrangement are possible.

Modifications and alterations in the form and arrangement of parts will suggest themselves to those skilled in the art and it is to be understood that such different forms of construction are contemplated as forming a part of this invention in so far as they fall within the scope of the following claims.

Thus the scope of the invention should be determined by the appended claims and their legal equivalents, rather than by the examples given.

I claim:

1. A fully assembled adjustable exercise configuration that has concentric and eccentric variable resistance for toning facial and neck muscles through movements of the head, forehead, mouth, lips, eyes, nose and neck; comprising:

(a) a head band with a frontal portion, a right and left lateral portion, and a posterior portion, said frontal portion is made of rigid flexible material shaped to the natural contour of the head, and being circumferentially discontinuous, said frontal portion ends behind each ear, said posterior portion comprises a posterior fastening means for fastening said head band around the head, sizing, and tightening, said posterior fastening means is made of durable fabric with a head Velcro first end and a head Velcro second end connections said first end is permanently fastened to the right end of said head band, and said second end is permanently fastened to the left end of said head band; permanently fastened on top of said right and left lateral portion of said head band above the ears a head fastening means for receiving a plurality of head resistance bands, said head fastening means is made of rigid non flexible material, said head fastening means comprises a plurality of head grooves, a plurality of head notches and a plurality of head gripping points;

(b) a neck band with a frontal portion, a right and left lateral portion, and a posterior portion, said frontal portion is made of rigid flexible material and being circumferentially discontinuous, said frontal portion ends behind each ear, said posterior portion comprises a posterior fastening means for fastening said neck band around the neck, and sizing, said posterior fastening means is made of durable fabric with a head Velcro first end and a head Velcro second end connections, said first end is permanently fastened to the right end of said neck band, and said second end is permanently fastened to the left end of said neck band; permanently fastened on top of said right and left lateral portion of said neck band above the ears a neck fastening means for receiving a plurality of neck resistance bands, said neck fastening means is made of rigid non flexible material, said neck fastening means comprises a plurality of neck grooves, a plurality of neck notches and a plurality of neck gripping points;

(c) a chin cup with a frontal portion, and a right and left lateral portion, said frontal and right and left lateral portions are made of rigid flexible material, said frontal portion is concaved for receiving the chin, and positioning said chin cup over the mouth area, permanently attached to said right and left lateral portions of said chin cup a means for receiving said plurality of head resistance bands and said plurality of neck resistance bands, said means comprises a right and left chin attachment knob, a plurality of chin grooves, a plurality of chin notches, and a plurality of chin gripping points, said means are aligned with said right and left lateral head fastening means, and said right and left lateral neck fastening means; and (d) whereby assemblage of said head band, said chin cup, said neck band and said plurality of resistance bands forms a single integral assemblage which allows for a combination variable levels of concentric contractions when the facial muscles are shortened while overcoming a constant resistance, and variable levels of eccentric contraction when the facial muscles are lengthened while over coming a constant resistance, when said posterior fastening means is pulled tightly to the head in conjunction with movements of the forehead, the forehead is exercised.

2. A method of exercising the muscles of facial expressions, the muscles of mastication and the chin muscles and their ancillaries muscles, comprising the steps of:

(a) fixedly securing a pair of beginners elongated head resistance bands of predetermined length and predetermined tensile strength to said right and left head fastening means located on said right and left lateral portion of said right and left lateral portion of said head band, and to said right and left chin attachment knob, located on said chin cup;

(b) fixedly securing a pair of beginners elongated neck resistance bands of predetermined length and predetermined tensile strength to said right and left neck fastening means located on said right and left lateral portion of said neck band, and to said right and left chin attachment knob located on said chin cup;

(c) securing said head band to user's head;

(d) positioning said chin cup to user's chin, said chin cup is additionally adapted to fit over the lip area;

(e) securing said neck band to user's neck; and (f) whereby the user's exercises the muscles of mastication by movements of the lower jaw, the muscles of expression by making various facial expressions, and the chin muscles when using the mouth area to push against said chin cup when placed over the mouth.

3. The exercise assemblage as claimed in claimed 1 wherein said fastening means includes:

(a) on said right and left lateral portions of said head band and said neck band the three vertically slanted juxtaposed grooves, within said grooves said plurality of notches, said plurality of gripping points, and (b) whereby said grooves provide variable levels of resistance when a pair of intermediate head and neck resistance bands, and a pair advance head and neck resistance bands are added for additional resistance, said intermediate and said advanced bands are manually engageable and disengageable, said notches are for adjusting, and positioning said resistance bands, and said gripping points are for securing said resistance bands.

4. The exercise assemblage as claimed in claim 1 wherein said attachment means includes:

(a) on the middle lateral portions of said chin cup the pivotal chin attachment knob for said beginners head and said neck resistance bands;

(b) on the upper lateral portions of said chin cup, said chin grooves for said intermediate and advanced head resistance bands, within said chin grooves an intermediate and advance head notch, and an intermediate and advanced head gripping point;

(c) on the upper lateral portions of said chin cup, said chin grooves for said intermediate and advanced neck resistance bands, within said chin grooves an intermediate and advance neck notch, and an intermediate and advanced neck gripping point; and (d) whereby said notches are for positioning said head and neck resistance bands, and said gripping points are for securely attaching said head and neck resistance bands into said grooves.

* * * * *